US011131122B2

(12) United States Patent
Macernis

(10) Patent No.: US 11,131,122 B2
(45) Date of Patent: Sep. 28, 2021

(54) SAFETY, SELF-LATCHING, MAGNETIC GATE LATCH DEVICE

(71) Applicant: Audrius Macernis, Seaford (AU)

(72) Inventor: Audrius Macernis, Seaford (AU)

( * ) Notice: Subject to any disclaimer, the term of this patent is extended or adjusted under 35 U.S.C. 154(b) by 427 days.

(21) Appl. No.: 13/937,228

(22) Filed: Jul. 9, 2013

(65) Prior Publication Data

US 2015/0015002 A1 Jan. 15, 2015

(51) Int. Cl.
*E05C 19/16* (2006.01)
*E05B 63/24* (2006.01)
*E05B 65/00* (2006.01)

(52) U.S. Cl.
CPC ..... *E05B 63/244* (2013.01); *E05B 65/0007* (2013.01); *E05B 65/0014* (2013.01); *E05C 19/163* (2013.01); *Y10T 292/11* (2015.04)

(58) Field of Classification Search
CPC ..... E05C 19/16; E05C 19/161; E05C 19/163; E05C 19/165; E05C 19/168; E05B 65/0007; E05B 63/244; E05B 65/0014
USPC .... 292/251.5, 137, 138, 145–147, 150, 174, 292/340, 341.15, 332, 333, 254, DIG. 29, 292/DIG. 37
See application file for complete search history.

(56) References Cited

U.S. PATENT DOCUMENTS 5,362,116 A * 11/1994 Doyle et al. ..... 292/144
5,664,769 A * 9/1997 Sadinsky et al. ..... 256/73
7,100,405 B2 * 9/2006 West ..... 70/100
2002/0095900 A1 * 7/2002 Blosfelds ..... 52/528
2008/0296915 A1 * 12/2008 Clark et al. ..... 292/251.5
2011/0148126 A1 * 6/2011 Macernis ..... 292/251.5
2011/0193354 A1 * 8/2011 Simmonds ..... 292/251.5
2011/0225890 A1 * 9/2011 Greenwood et al. ..... 49/394
2012/0011775 A1 * 1/2012 Chen ..... 49/358
2014/0054904 A1 * 2/2014 Andrews et al. ..... 292/144
2014/0225383 A1 * 8/2014 Simmonds et al. ..... 292/238

FOREIGN PATENT DOCUMENTS

CA 2504115 A1 * 10/2005
WO WO 2011088496 A1 * 7/2011
WO WO2014127398 A1 * 8/2014
WO WO2014127399 A1 * 8/2014
WO WO2014127413 A1 * 8/2014

* cited by examiner

*Primary Examiner* — Alyson M Merlino

(57) ABSTRACT

Disclosed is a self-latching gate latch device. The device comprises a latch and a magnet assembly housing. The latch assembly housing, secured to a hinged gate, comprises a slidable horizontal latch bar, attractable by a magnet. The magnet assembly housing comprises a slidable vertical magnet bar secured with a magnet at the bottom thereof. In a lock position of the magnet bar, the latch bar engages the magnet. The magnet assembly housing further comprises a locking member that, in an engagement position, engages the magnet bar to the magnet assembly housing preventing the magnet bar from any upward movement. Within the magnet bar is disposed a lock bar, which when depressed, frees the magnet bar.

13 Claims, 15 Drawing Sheets

SAFETY, SELF-LATCHING, MAGNETIC GATE LATCH DEVICE

BACKGROUND

The present invention relates to gate latches, more particularly to safety magnetic gate latches that are installed on swimming pool gates and the operating means thereof are out of the reach of small children, and even more particularly related to a safety magnetic self-latching gate latch that provides extra safety by not only having the operating means thereof out of the reach of small children but also by configuring the operating means such that, a user has to execute a sequence of operational steps in order to release the latch.

A conventional swimming pool gate latch basically comprises a latch assembly preferably fitted to a hinged gate and a magnet assembly fitted to a fence post or in some cases another hinged gate. The magnet assembly usually is elongate in construction and is vertically fitted to the fence post. The magnet assembly comprises a release knob disposed atop thereof wherein, the release knob simply needs to be lifted in order to release or unlatch the gate. The gate latch is further designed to be a safety device as the release knob positioned is at that height that it is out of the reach of small children. However, for a determined child, the placement of release knob may not pose that big of a challenge as the release knob can be arguably easily lifted with the help of an elongate object. This is because, the operation of the release knob, as mentioned earlier, is quite simple.

SUMMARY

The present invention is an improved safety self-latching gate latch device that comprises a latch bar assembly that is configured to engage a magnet bar assembly. The magnet bar assembly comprises a vertical elongate magnet bar that is slidably received within an elongate magnet assembly housing fitted to a fence post. A top portion of the magnet bar extends beyond the top of the magnet assembly housing through a magnet bar hole, while the bottom extremity of the magnet bar is secured to a magnet. The magnet assembly housing further comprises a latch hole disposed at the bottom portion thereof wherein, when the magnet bar is at rest at a downward position within the magnet assembly housing, the magnet is aligned with the latch hole. The latch bar assembly comprises a latch bar attractable by a magnet, horizontally disposed within latch assembly housing wherein, the latch bar is movable between a default latch bar disengagement position and a latch bar engagement position, where a substantial portion of the latch bar extends out of the latch assembly. When the hinged gate closed, the latch bar, due to attraction force of the magnet (in the downward position), arrives into latch bar engagement position at which point, the latch bar adheres to the magnet through the latch hole.

The magnet bar further comprises a lock bar slidaby disposed within the top portion. More particularly, the lock bar is movable from a default upward lock bar engagement position to a downward lock bar disengagement position. The hollow of the magnet bar, within which, the lock bar is received, comprises a pair of identical wall holes, the top surface of which aligns with a horizontal, first engagement surface disposed on the interior of the magnet assembly housing when the magnet bar is at rest. The magnet assembly housing further comprises a locking member comprising a horizontal second engagement surface. When the magnet and lock bars are in default position thereof, the second engagement surface engages the first engagement surface through a wall hole thereby preventing the magnet bar from any upward movement. In order to free the magnet bar, the lock bar is depressed within the magnet bar, resulting in the second engagement surface to disengage from the first. Once the locking member is disengaged, the magnet bar is free to be lifted upwards so as to unlatch the hinged gate from the fence post.

Other objects and advantages of the embodiments herein will become readily apparent from the following detailed description taken in conjunction with the accompanying drawings.

FIGURES—REFERENCE NUMERALS

10 . . . Safety Self-latching Magnetic Gate Latch Device
12 . . . Hinged Gate
14 . . . Fence Post
16 . . . Latch Bar Assembly
18 . . . Magnet Bar Assembly
20 . . . Latch Assembly Housing
22 . . . Side Cap
24 . . . Latch Bar
26 . . . Latch Bar Elongate Section
28 . . . Latch Bar Head Section
30 . . . Internal Wall Member
32 . . . Ring-shaped Washer
34 . . . Compression Spring
36 . . . Magnet Assembly Housing
38 . . . Latch Hole
40 . . . Top Cap
42 . . . Cylindrical Tubing
44 . . . U-shaped Groove
46 . . . First Engagement Surface
48 . . . Magnet Bar
50 . . . Magnet Bar Elongate Section
52 . . . Release Knob
56 . . . Magnet
58 . . . Cylindrical Void or Hollow
60 . . . Wall Hole
62 . . . Lock Bar
64 . . . Top Press Section
66 . . . Lock Bar Elongate Section
68 . . . Hollow Cylinder
70 . . . Solid Cylindrical Section
72 . . . Lock Hole
74 . . . Lock Hole Wall
76 . . . Cylindrical Cross Member
78 . . . Locking Member
80 . . . Top, Second Engagement Surface
82 . . . Bottom Surface
84 . . . Slanted Side Surface
86 . . . Vertical Side Surface
88 . . . Front/Rear Surface
90 . . . Oblique Hole

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 1:
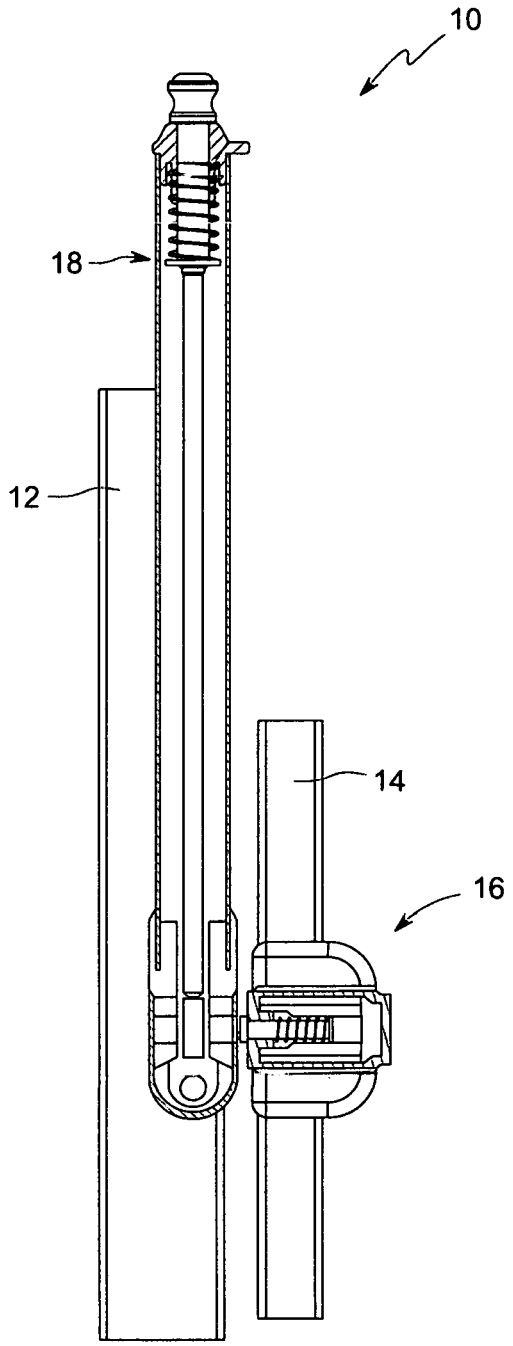
FIG. 1, according to an embodiment of the present invention, is a front view of the self-latching device with only the latch and magnet assembly housings being sectioned off.

Referring to FIG. 1, the present invention comprises an improved self-latching magnetic gate latch device 10 for releasingly securing or simply latching a hinged gate 12 to a barrier member, which generally comprises a fence post 14. However, the barrier member could be another hinged gate as well. More particularly, the self-latching device 10 is designed to be a safety device for installation on swimming pool gates especially. The self-latching device 10, like any conventional latching device, spans two basic parts or components, viz., a latch bar assembly 16 and a magnet bar assembly 18, that are configured to engage one another in order to form a latch.

Figure 2:
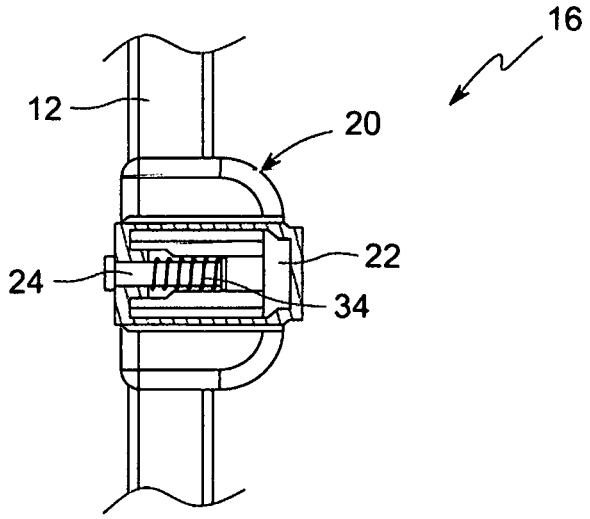
FIG. 2, according to an embodiment of the present invention, is a front view of the latch assembly housing with the latch bar being in the default latch bar disengagement position; the latch assembly housing being sectioned off.

Referring to FIG. 2, the latch bar assembly 16 comprises a substantially rectangular latch assembly housing 20 secured to a vertical end section at the free extremity of the hinged gate 12 such that, the latch assembly housing 20 is horizontally oriented. The latch assembly housing 20 is secured to the hinged gate 12 preferably by means of commonplace securing means, such as brackets. Either side end of the latch assembly housing 20 is open wherein, the opening, which is disposed away from the free end of the hinged gate 12, is larger than the other so as to provide access to the components within the latch assembly housing 20 for maintenance purposes. The larger side opening is removably sealed off with a side cap 22.

Figure 3:
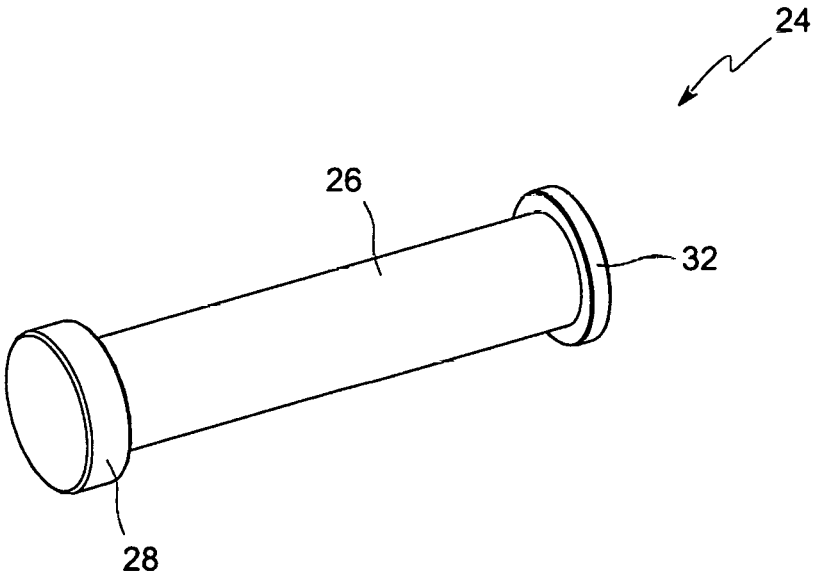
FIG. 3 is a perspective view of the latch bar according to an embodiment of the present invention.

Referring to FIGS. 2 and 3, the latch assembly housing 20 further comprises a horizontal latch bar 24 disposed therewithin wherein, the latch bar 24 is attractable by a magnet. The latch bar 24 is a unitary piece composed of two coaxial sections viz., a latch bar elongate section 26 and a latch bar head section 28 extending from an extremity of the latch bar elongate section 26 wherein, the latch bar head section 28 is disposed at the extremity of the hinged gate 12. Each of the two sections 26 and 28 is of uniform circular cross-section with the cross-sectional diameter of the latch bar elongate section 26 is lesser than that of the latch bar head section 28. The free end of the latch bar head section 28 is preferably configured to be flat. The smaller side opening of the latch assembly housing 20 is configured to be smaller than the cross-sectional diameter of the latch bar head section 28 while being larger than that of the latch bar elongate section 26. This results in the latch bar elongate section 26 being within the latch assembly housing 20, while the latch bar head section 28 remains out of the latch assembly housing 20 at all times.

Figure 4:
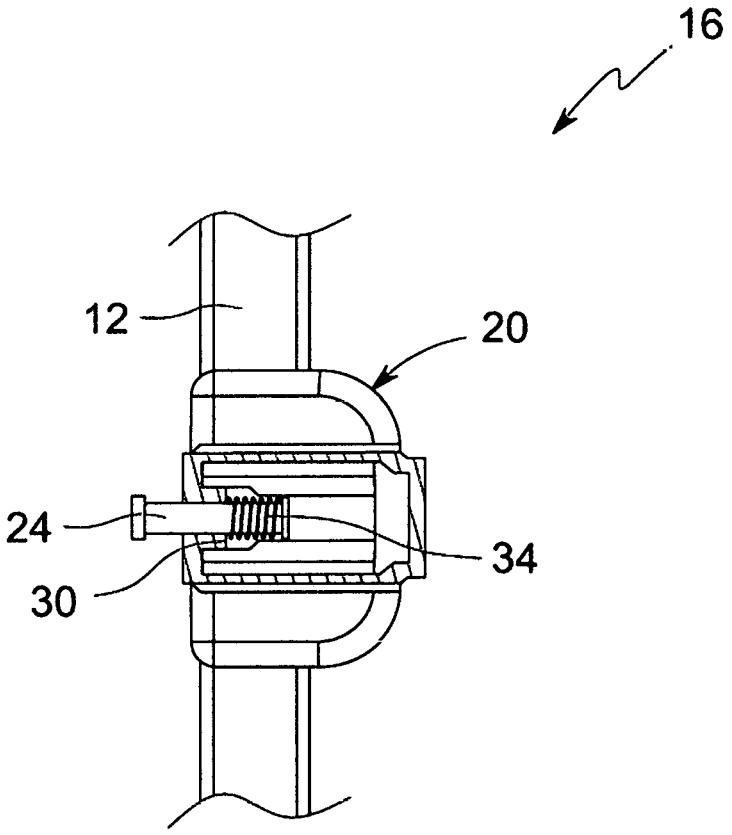
FIG. 4, according to an embodiment of the present invention, is a front view of the latch assembly housing with the latch bar being in the latch bar engagement position; the latch assembly housing being sectioned off.

Referring to FIGS. 2 through 4, the latch bar 24 is slidably disposed within the latch assembly housing 20 such that, the latch bar 24 is movable from a default backward latch bar disengagement position (FIG. 2), where the latch bar elongate section 26 is completely within the latch assembly housing 20, to a forward latch bar engagement position (FIG. 4), where a substantial length of the latch bar elongate section 26 extends of the smaller side opening of the latch assembly housing 20. The latch assembly housing 20 further comprises an internal wall member 30 disposed therewithin at small distance away from the middle thereof and towards the smaller side opening. The wall member 30 comprises a central hole through with the latch bar elongate section 26 is slidably received as the latch bar 24 is received within the latch assembly housing 20. The latch bar 24 further comprises a ring-shaped washer 32 encircling the free extremity (opposite to the head section 28) of the latch bar elongate section 26. A compression spring 34 is coiled around the latch bar elongate section 26 between the wall member 30 and the washer 32 so as to enable the latch bar 24 to be biased towards the latch bar disengagement position (FIG. 2).

Figure 5:
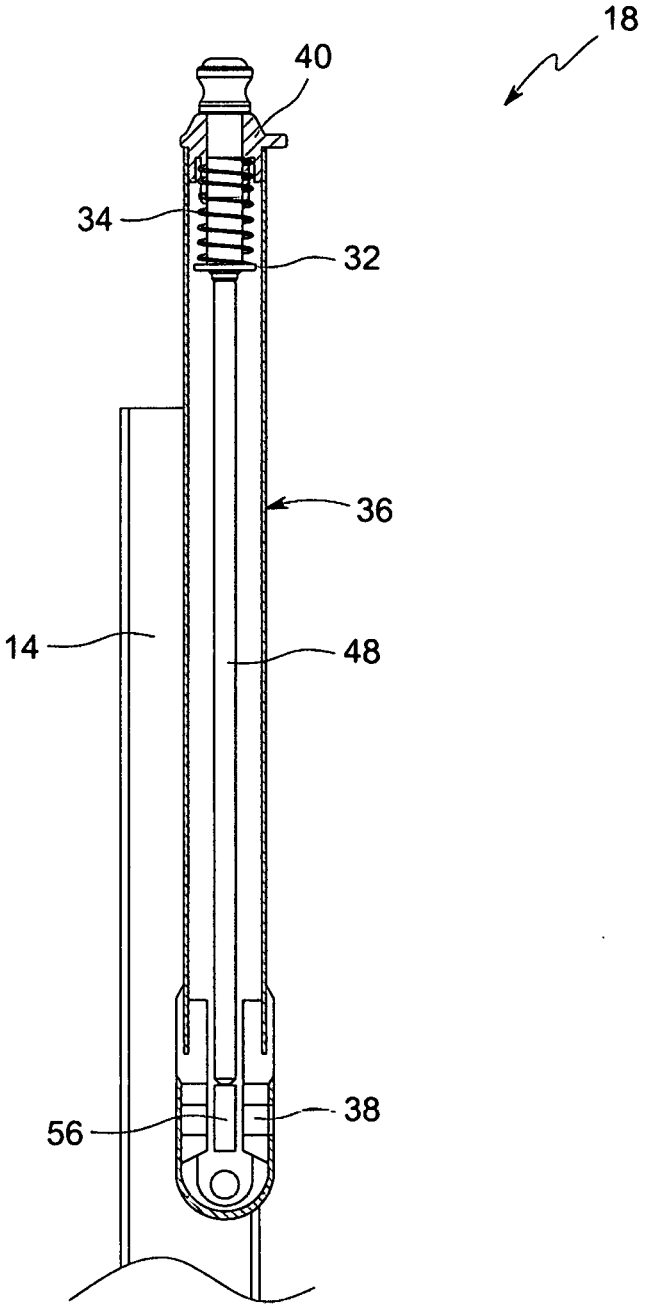
FIG. 5, according to an embodiment of the present invention, is a front view of the magnet assembly housing with the magnet bar being in the default downward magnet bar engagement position; the magnet assembly housing being sectioned off.
Figure 6:
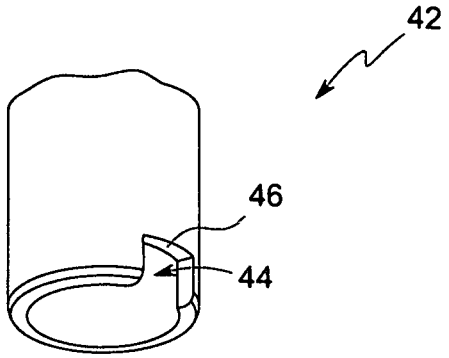
FIG. 6, according to an embodiment of the present invention, is a perspective view of the tubing showing the U-shaped groove.

Referring to FIGS. 1, 5 and 6, the magnet bar assembly 18 comprises a substantially rectangular elongate magnet assembly housing 36 that is vertically secured to a fence post 14 preferably by means of brackets. The magnet assembly housing 36 comprises a latch hole 38 disposed on the bottom section thereof. More particularly, the magnet assembly housing 36 is secured to the fence post 14 such that, latch hole 38 aligns with the smaller side opening of the latch assembly housing 20 as seen in FIG. 1. The latch hole 38 is configured to be dimensionally larger than the latch bar head section 28, the reason for which will be apparent from the following body of text. The magnet assembly housing 36 has an open top for providing access to the internal components thereof for maintenance purposes. The open top is removably fitted with a top cap 40 having a magnet bar hole centrally disposed thereon. The top cap further comprises a relatively short cylindrical tubing 42 (FIG. 6) descending vertically from the circumference of the magnet bar hole. The free bottom extremity of the tubing 42 comprises a (inverted) U-shaped groove 44 defined by a pair of vertical surfaces connected together by horizontal first engagement surface 46.

Figure 7:
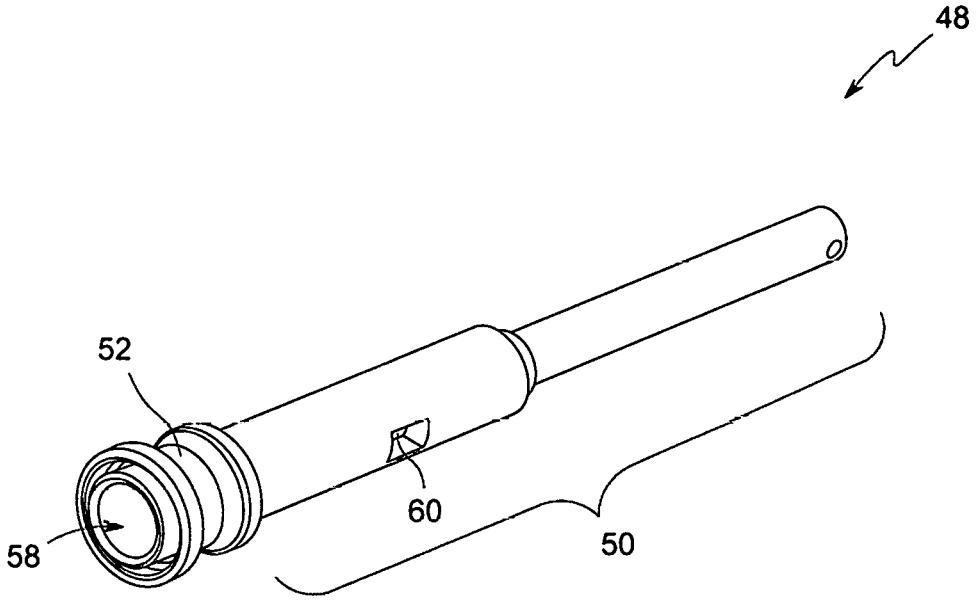
FIG. 7 is a perspective view of the magnet bar according to an embodiment of the present invention.
Figure 8:
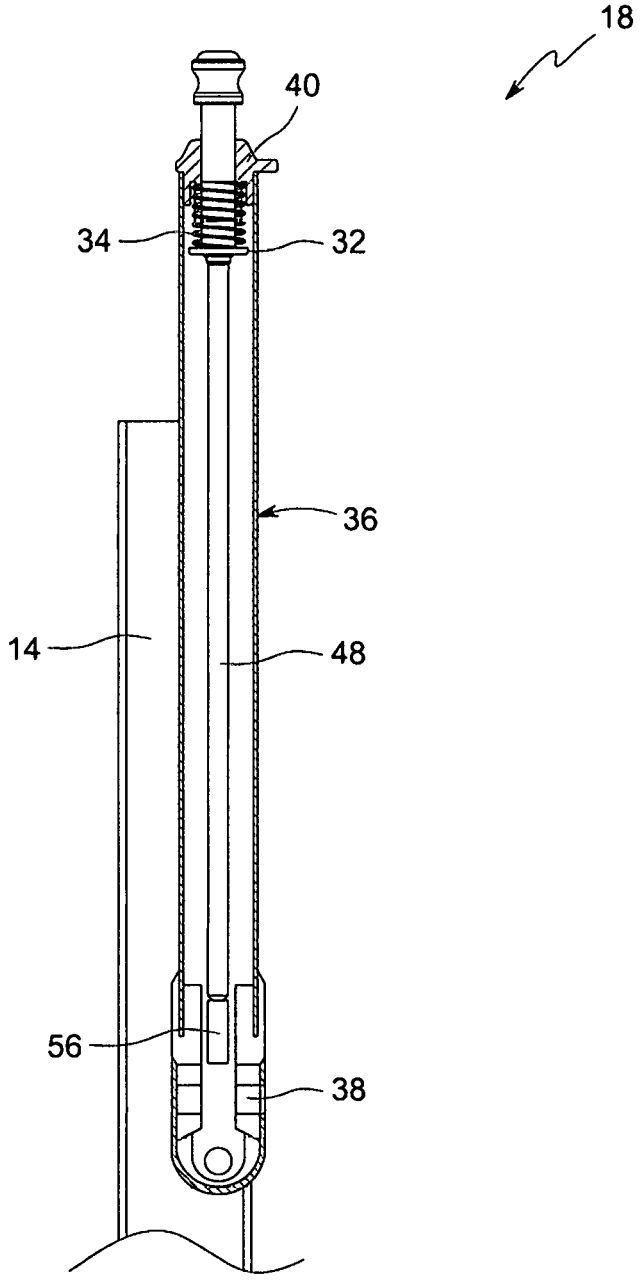
FIG. 8, according to an embodiment of the present invention, is a front view of the magnet assembly housing with the magnet bar being in the upward magnet bar disengagement position; the magnet assembly housing being sectioned off.

Referring to FIGS. 5, 7 and 8, the magnet assembly housing 36 further comprises an elongate magnet bar 48, preferably of stepped circular cross-section, vertically disposed therewithin. The magnet bar 48 is composed of two coaxial sections viz., a magnet bar elongate section 50 and a release knob 52 disposed atop magnet bar elongate section 50 wherein, the cross-sectional area of the release knob 52 is larger than that of the magnet bar elongate section 50. In one embodiment, the release knob 52 is integral with the magnet bar elongate section 50. The free end of the magnet bar elongate section 50 is secured to a magnet 56 (FIGS. 5 and 8). In one embodiment, the magnet 56 is disposed within a casing (not shown) that is secured to the bottom of the magnet bar 48. The magnet bar 48 is received within the magnet assembly housing 36 such that, the magnet bar elongate section 50 stays substantially therewithin, while the release knob 52 extends out of the magnet assembly housing 36 and stays atop the magnet bar hole. In one embodiment, the magnet bar 48 is shaped such that, the magnet bar elongate section 50 is snugly received within the tubing 42. The magnet bar 48 is slidably received within the magnet assembly housing 36 such that, the magnet bar 48 is vertically movable from a default downward magnet bar engagement position (FIG. 5), where the whole of the magnet bar elongate section 50 resides within the magnet assembly housing 36, to an upward magnet bar disengagement position (FIG. 8), where a portion of the magnet bar elongate section 50 beneath the release knob 52 extends out of the top cap 40 through the magnet bar hole. Notably, in the magnet bar engagement position (FIG. 5), the magnet 56, as seen in FIG. 1, aligns with the latch hole 38, the utility of which will be apparent from the following body of text. Further, a ring-shaped washer 32 encircles around magnet bar elongate section 50 at a point beneath the tubing 42 and a compression spring 34 is coiled between the washer 32 and the underside of the top cap 40. This causes the magnet bar 48 to be biased towards the magnet bar engagement position (FIG. 5).

Figure 9:
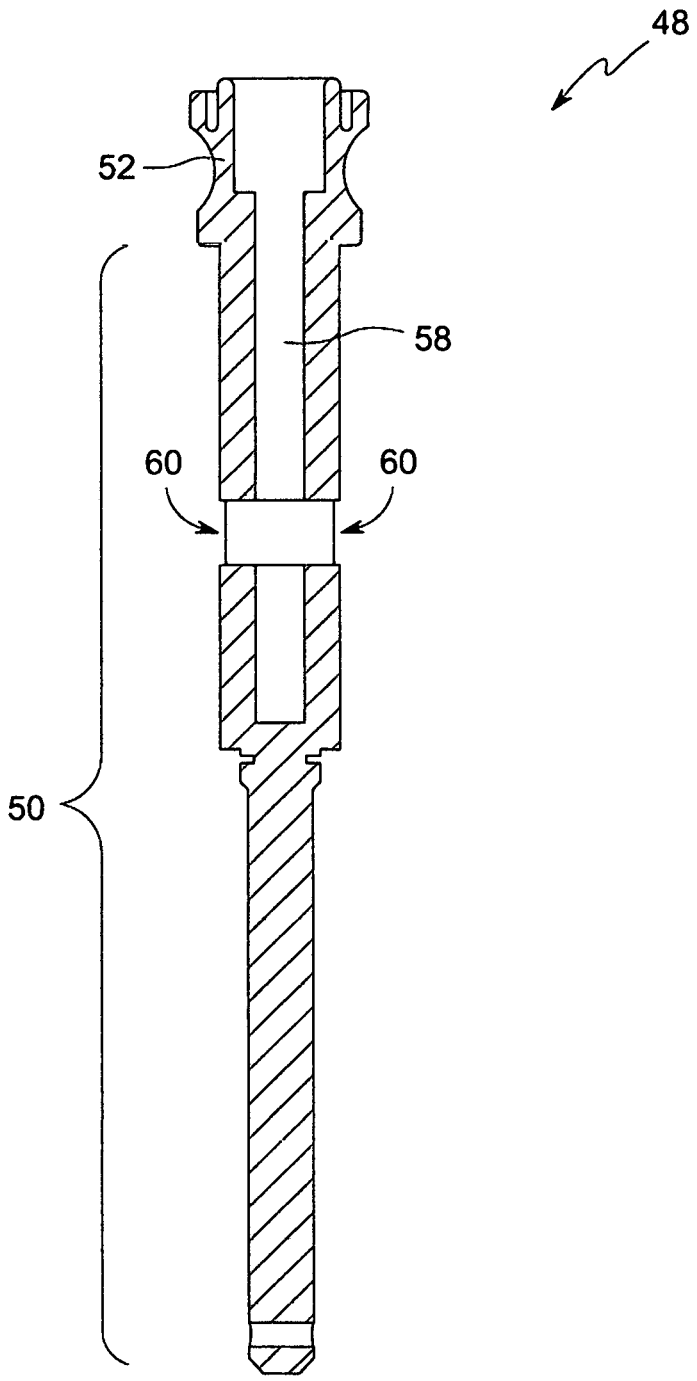
FIG. 9 is a front sectional view of the magnet bar (without the lock bar and the locking member therewithin) according to an embodiment of the present invention.

Referring to FIGS. 7 and 9, a portion or section of the length of the magnet bar 48 from the top thereof (including the release knob 52) is hollowed out to form a cylindrical void or hollow 58. A pair of identical, opposing, rectangular wall holes 60 is cut into the cylindrical wall of the magnet bar 48, which is formed out of the cylindrical void 58. The magnet bar 48 is configured such that, the top surface of each rectangular wall hole 60 aligns with the first engagement surface 46 (FIG. 6) when the magnet bar 48 is in the magnet bar engagement position (FIG. 5). The cylindrical hollow 58 is adapted to slidably receive a disengagement means therewithin.

Figure 10:
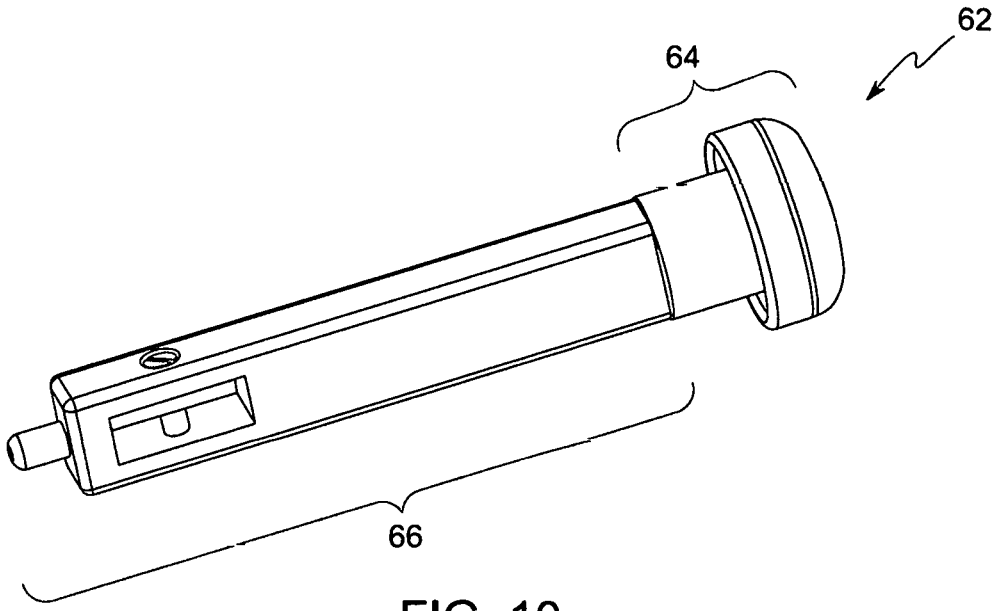
FIG. 10 is a perspective view of the lock bar according to an embodiment of the present invention.
Figure 11:
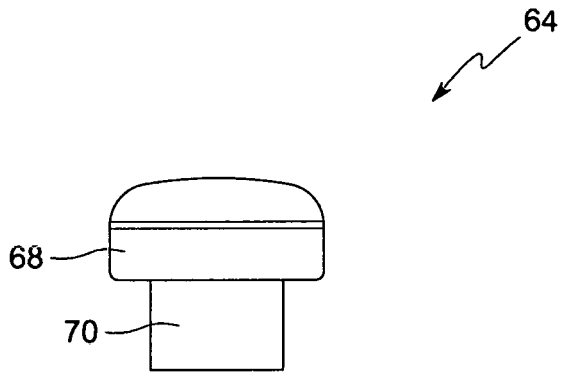
FIG. 11 is a perspective view of the top press section of the lock bar according to an embodiment of the present invention.
Figure 12:
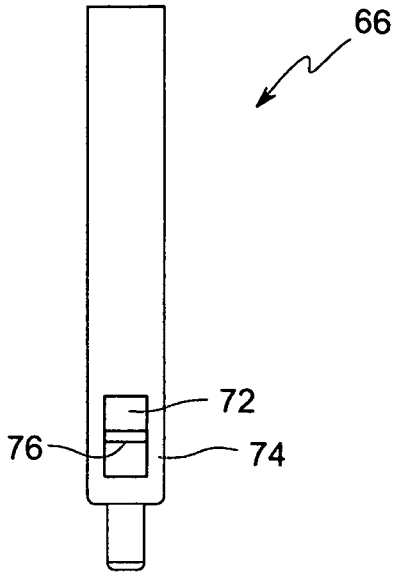
FIG. 12 is a perspective view of the lock bar elongate section according to an embodiment of the present invention.

Referring to FIGS. 10 through 12, the disengagement means comprises an elongate lock bar 62 is divided into a top press section 64 and a lock bar elongate section 66 coaxially extending from the free extremity of the top press section 64. More particularly, the top press section 64 comprises a hollow cylinder 68 with the top thereof being closed and a solid cylindrical section 70 extending centrally from the underside of the hollow cylinder 68. The lock bar elongate section 66 is a bar of uniform rectangular cross-section extending from the free extremity of the solid cylindrical section 70. The lock bar elongate section 70 comprises a thorough rectangular lateral lock hole 72, which is disposed between a pair of lock hole walls 74 integral with the lock bar elongate section 66. Notably, the length of lock hole 72 (in the axial direction of the lock bar 62) is greater than that of a wall hole 60 (FIG. 7). Further, the lock bar elongate section 66 comprises a horizontal, cylindrical cross member 76 is fitted between the lock hole walls centrally. In one embodiment, the cross member 76 comprises roller.

Figure 13:
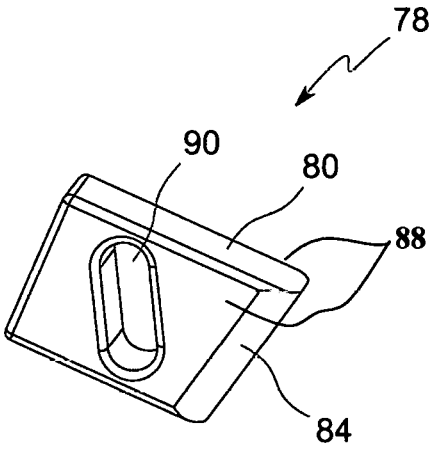
FIGS. 13 and 14 are perspective views of the locking member according to an embodiment of the present invention.
Figure 14:
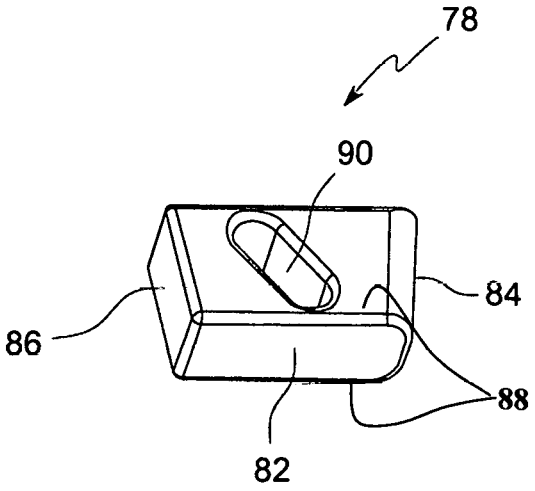

Referring to FIGS. 13 and 14, the magnet assembly housing 36 further comprises a locking member 78 that is substantially rectangular in shape saving for one side that is slanted. The locking member 78 is defined by a top, horizontal, second engagement surface 80, a horizontal bottom surface 82 opposite to the top second engagement surface 80, a forwardly slanted side surface 84, a vertical side surface 86 opposite to slanted surface 84, and identical, vertical, opposing pair of front and rear surfaces 88. The locking member 78 further comprises a thorough backwardly-slanted oblique hole 90 extending between the front and rear surfaces 88, the utility of which will be apparent from the following body of text. Preferably the edges joining the pair of front and rear surfaces 88 and the slanted surface 84 are rounded off as seen the referred drawing.

Figure 15:
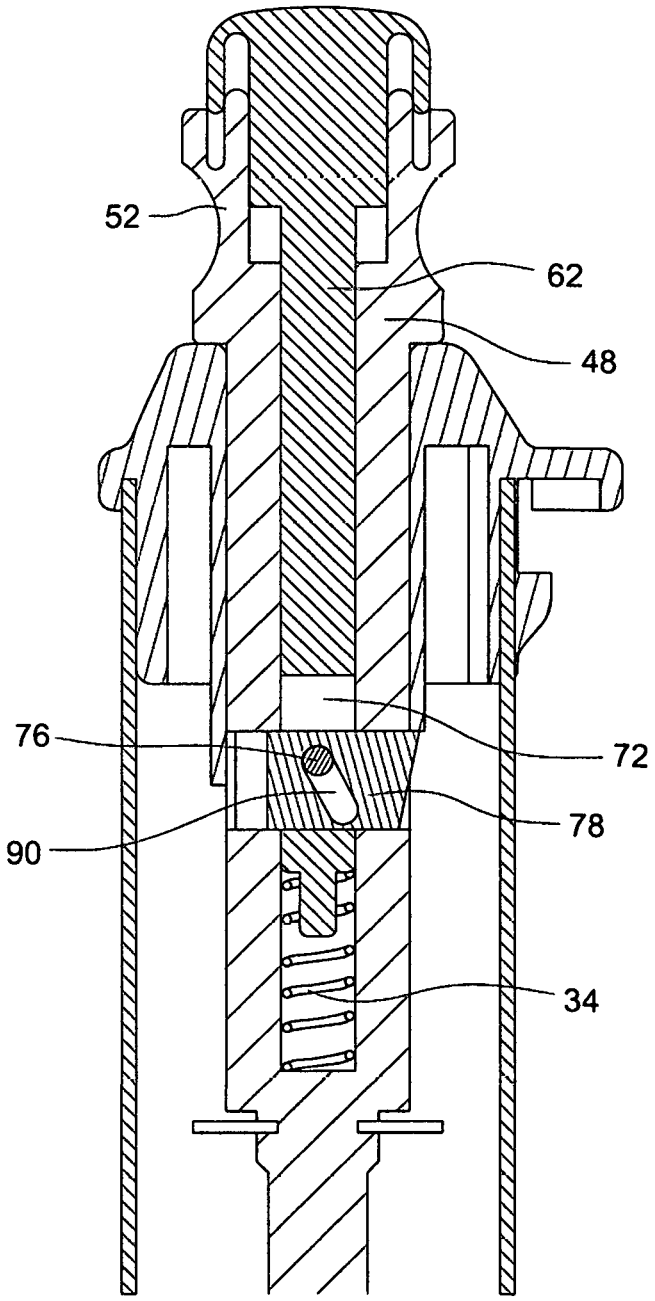
FIGS. 15 through 19, according to an embodiment of the present invention, are the sequential illustrations of the movements of the lock bar and the magnet bar that are performed in order to unlatch the gate latch device.
Figure 16:
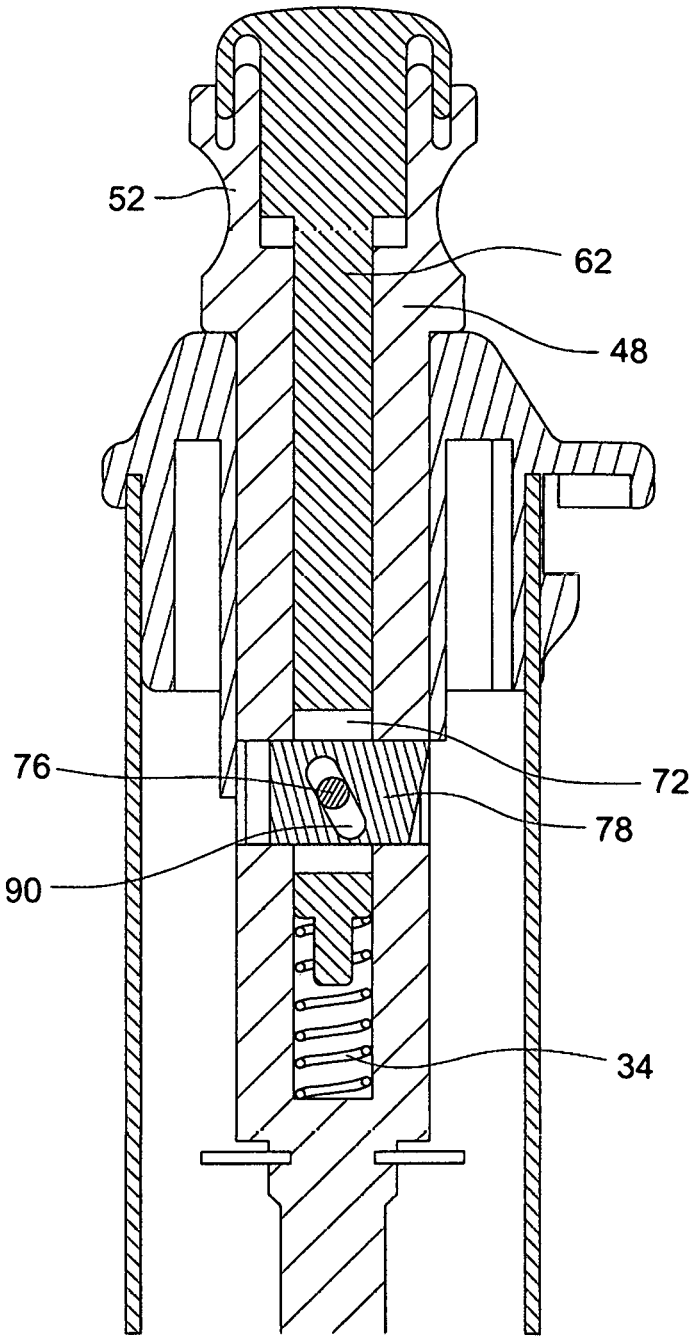
Figure 17:
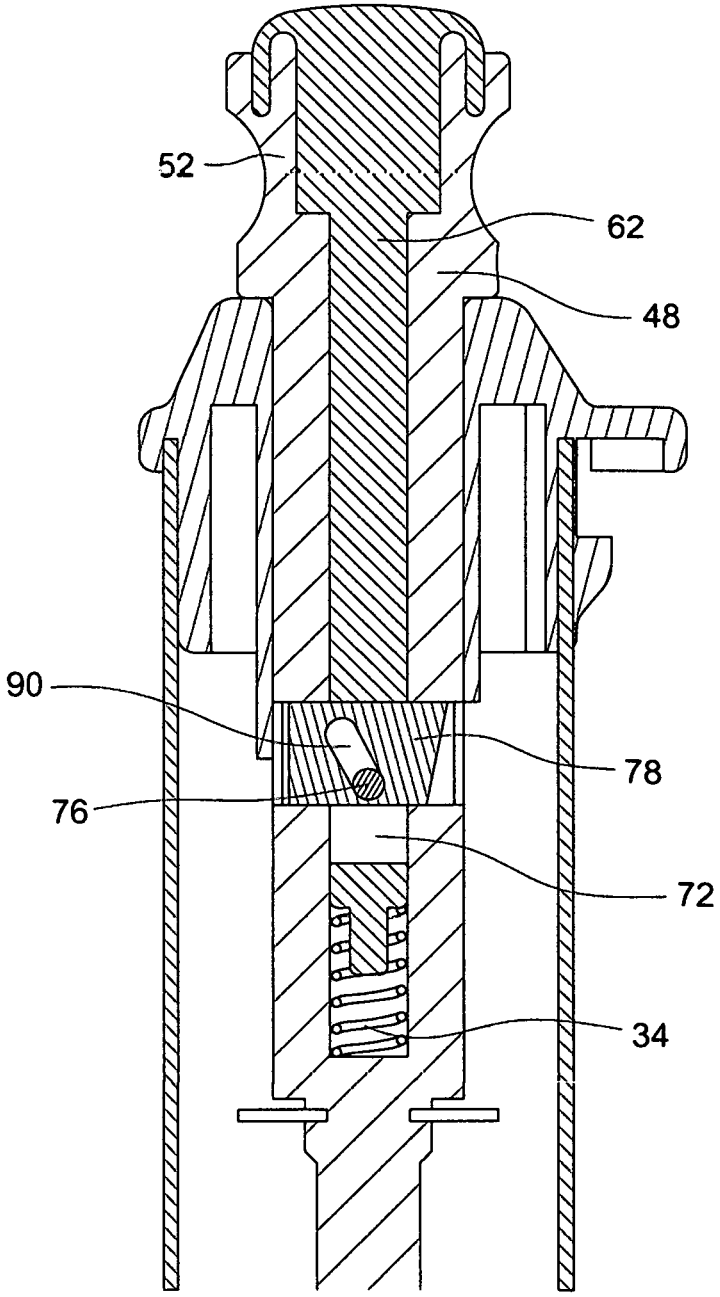

Referring to FIGS. 15 through 17, as the lock bar 62 is received within the magnet bar 48, the locking member 78 is snugly and slidably received within the wall holes through the lock hole 72, as the cross member 76 is slidably received within the oblique hole 90. More particularly, the top and bottom surfaces of the locking member 78 abut the top and bottom surfaces of the wall holes respectively as the locking member 78 is slidably received within wall holes. The lock bar 62 is slidably received within the hollow of the magnet bar 48 such that, the lock bar 62 is movable from a default upward lock bar engagement position (FIG. 15) to a downward lock bar disengagement position (FIG. 17). Therefore, as the lock bar 62 is moved from the lock bar engagement position to the lock bar disengagement position (FIGS. 15 through 17), the cross member 76 traverses from the top to the bottom of the oblique hole 90 respectively. This movement of the cross member 76, in turn, causes the locking member 78 to move from left to right (as the magnet assembly housing is viewed from the front thereof). A compression spring 34 is disposed between the bottom end of the lock bar 62 and the bottom surface of the hollow of the magnet bar 48 thereby, causing the lock bar 62 to be upwardly biased. Notably, in the lock bar engagement position, the top surface of the top press section 64 is flush with the top surface of the release knob 52.

Figure 18:
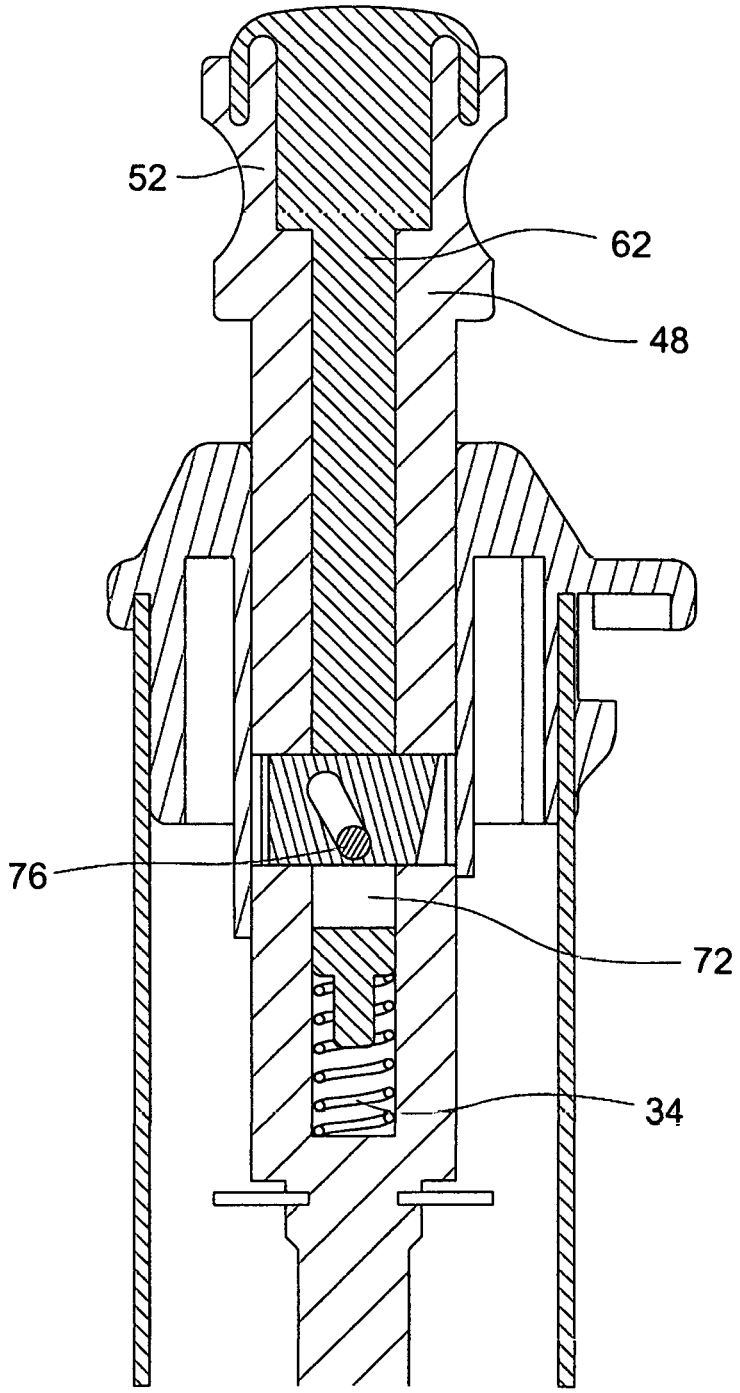
Figure 19:
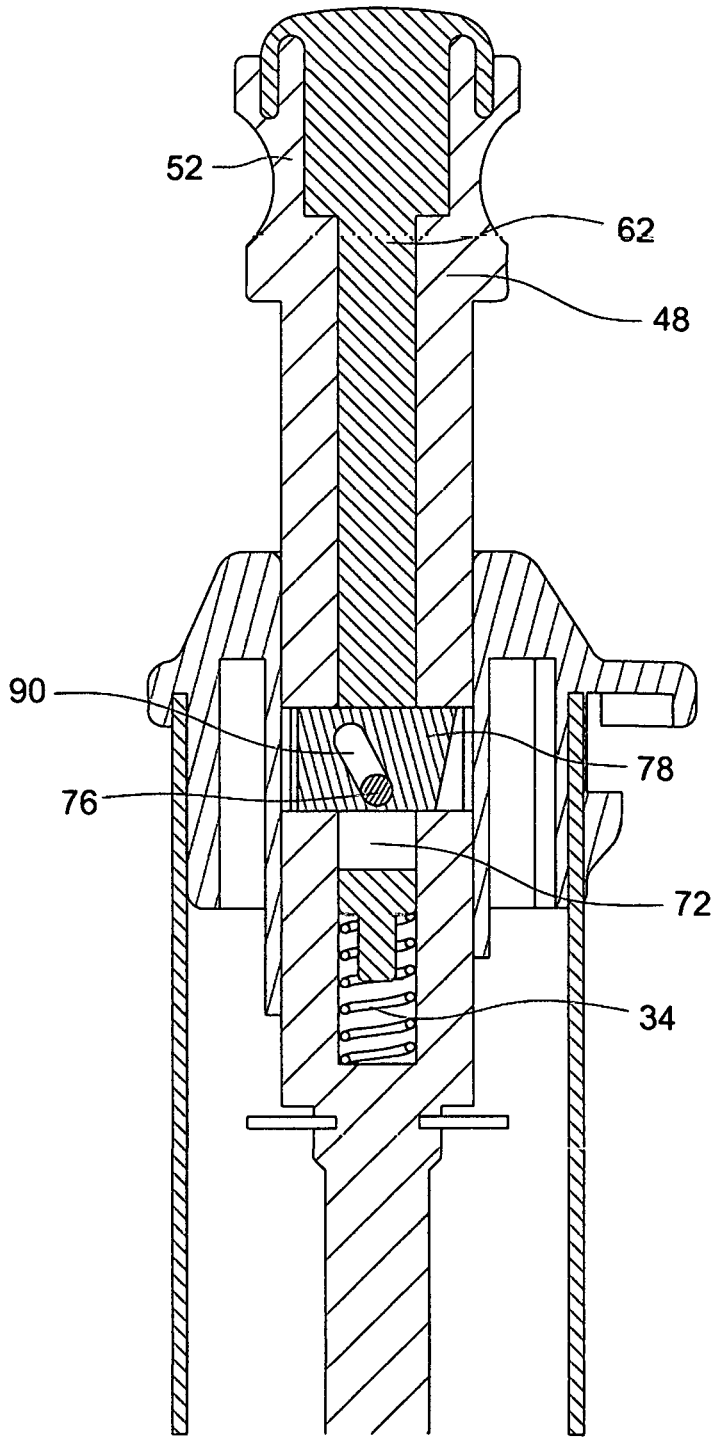

Referring to FIGS. 15 through 19, the magnet bar assembly is configured such that, when the magnet bar 48 and the lock bar 62 are in the respective default positions thereof, the cross member 76 is at the top extremity of the oblique hole 90. As the cross member 76 is at the top extremity of the oblique hole 90, the second engagement surface of the locking member 78 engages the first engagement surface on the tubing 42 thereby, preventing the magnet bar 48 (in the magnet bar engagement position) from any upward movement thereof. Depressing the lock bar 62 causes the cross member 76 to traverse from the top to the bottom extremity of the oblique hole 90 (FIGS. 15 through 17) resulting in the locking member 78 to retract backwards. This, in turn, results in disengagement between the first and the second engagement surfaces (FIG. 17) at which point, the magnet bar 48 is free to move upwards as seen in FIGS. 17 through 19.

Figure 20:
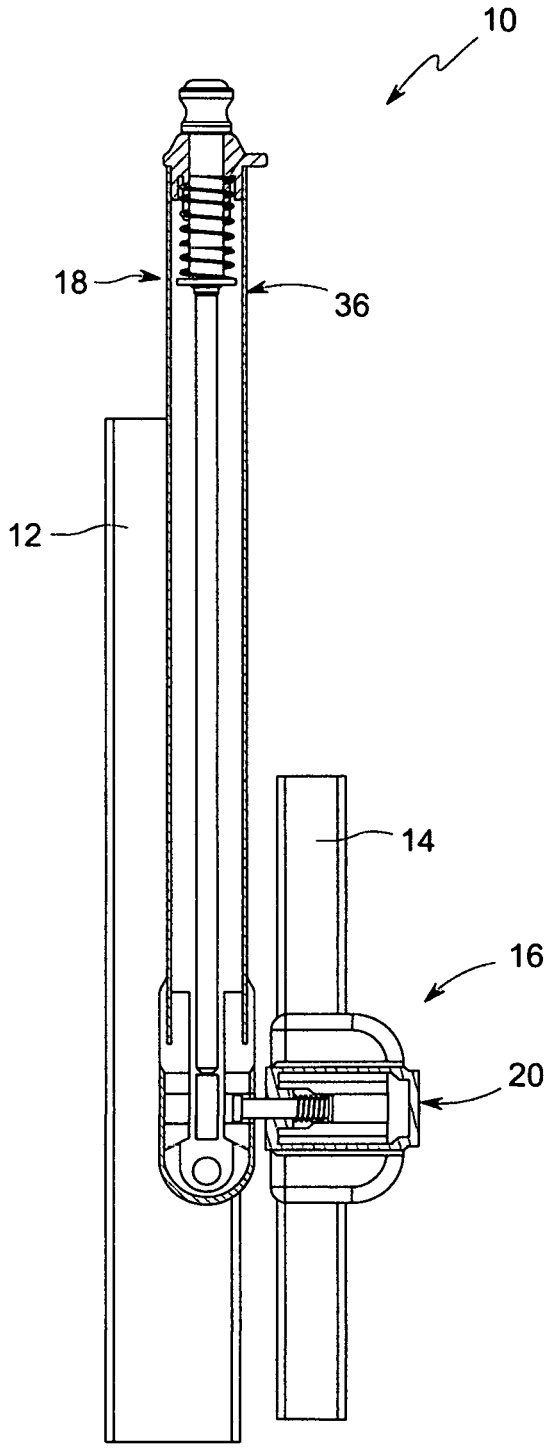
FIG. 20, according to an embodiment of the present invention, is a front view of the latched self-latching device with only the latch and magnet assembly housings being sectioned off.

Referring to FIGS. 15 through 20, in order to latch the hinged gate 12 to the fence post 14, the hinged gate 12 simply needs to be aligned with the fence post 14 at which point, the magnet 56, which, by default, is aligned with the latch hole 38, attracts the latch bar 24 towards itself. As the attraction force of the magnet is configured to be stronger than the opposing force of the spring 34 coiled around the latch bar 24, the latch bar 24 adheres to the magnet through the latch hole 38 thereby latching the hinged gate 12 to the fence post 14 as seen in FIG. 20. In order to release the hinged gate 12 from the latch, initially, the top press section 64 is depressed causing the magnet bar 48 to be free. At this point, the release knob 52 is manually lifted upward (FIGS. 17 through 19), which causes the magnet bar 48, and thereby the magnet, to move upwards. The elevation of magnet causes the attraction power between the latch bar 24 and the magnet to weaken resulting in the latch bar 24 being retracted into the latch assembly housing 20 (due to the spring 34) thereby unlatching the hinged gate 12 from the fence post 14. The self-latching device 10 is a safety device and therefore, the release knob 52 is configured to be at a height that is unreachable for small children.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

What is claimed is:

1. A self-latching magnetic gate latch device for latching a hinged gate to an opposing barrier member, the self-latching device comprising:

(a) a latch bar assembly comprising:

(i) a latch assembly housing fitted to one of the hinged gate and the barrier member; and (ii) a horizontally-disposed latch bar slidably disposed within the latch assembly housing such that the latch bar is axially movable from a default backward latch bar disengagement position to a forward latch bar engagement position, the latch bar biased towards the latch bar disengagement position, the latch bar attractable by a magnet;

(b) a magnet bar assembly comprising:

(i) an elongate magnet assembly housing vertically fitted to the other of the hinged gate and the barrier member whereon the latch assembly housing is not fitted, the interior surface of the magnet assembly housing comprising a horizontal first engagement surface, the magnet assembly housing comprising a latch hole axially aligned with the latch bar;

(ii) an elongate vertical magnet bar comprising the magnet secured to the bottom thereof, the magnet bar slidably disposed within the magnet assembly housing such that, the magnet bar is manually vertically movable from a default downward magnet bar engagement position to an upward magnet bar disengagement position, the magnet bar biased towards the magnet bar engagement position, where the magnet, via the latch hole, is aligned with the latch bar, the magnet bar movable by manually lifting a top portion thereof, which extends beyond and through a top of the magnet assembly housing; and (iii) a disengagement means disposed within the top portion of the magnet bar; and (c) a locking member disposed in conjunction with the magnet bar, the locking member comprising a horizontal top second engagement surface and is horizontally slidably movable between a forward locking member engagement position and a backward locking member disengagement position upon the deployment of the disengagement means, wherein when the locking member is in the locking member engagement position and the magnet bar is in the magnet bar engagement position, the second engagement surface engages the first engagement surface via the magnet bar, thereby preventing any upward movement of the magnet bar, wherein when the locking member is in the backward locking member disengagement position, the second engagement surface disengages the first engagement surface, thereby allowing the magnet bar to be moved upwards out of the magnet bar engagement position, wherein the locking member is biased towards the forward locking member engagement position;

wherein when the magnet bar is in the magnet bar engagement position and the hinged gate and the barrier member are brought into opposition to one another, the latch bar is longitudinally aligned with the magnet such that an attraction force of the magnet moves the latch bar to the latch bar engagement position, in which the latch bar abuts the magnet through the magnet assembly housing thereby latching the hinged gate to the barrier member, and when the magnet bar is moved upwards to the magnet bar disengagement position, the distance between the magnet and the latch bar is increased, causing the attraction force between the magnet and the latch bar to weaken, resulting in the latch bar retracting into the latch bar disengagement position thereby unlatching the hinged gate from the barrier member.

2. The self-latching device of claim 1, wherein the barrier member comprises a fence post.

3. The self-latching device of claim 1, wherein the barrier member comprises another gate.

4. The self-latching device of claim 1, wherein the disengagement means comprises an elongate vertical lock bar comprising:

(a) a thorough lateral lock hole, a horizontal axis of which is perpendicular to a vertical axis of the lock bar, the lock hole is disposed between a pair of opposing flat lock hole walls integral with the lock bar, wherein the lock bar received within a hollow portion of the top portion of the magnet bar, wherein a circumferential wall of the hollow portion of the magnet bar comprises a pair of lateral, opposing, identical wall holes, each of which comprises a horizontal wall hole top surface that aligns with the first engagement surface when the magnet bar is in the magnet bar engagement position, the lock bar is received within the hollow portion of the magnet bar such that the lock hole is disposed between the pair of wall holes, a cross-sectional height of each of the wall holes extending along an axis of the magnet is lesser than a cross-sectional height of the lock hole, wherein the lock bar is manually movable from a default upward lock bar engagement position to a downward lock bar disengagement position, wherein the lock bar is biased towards the lock bar engagement position; and a horizontally-disposed elongate cylindrical cross member centrally fitted between the pair of lock hole walls such that the cross member is perpendicular to either lock hole wall, wherein the cross member is slidably received within an elongate, backwardly oblique through hole disposed in the locking member, wherein when the lock bar is in the lock bar engagement position, the cross member is at a top extremity of the oblique through hole, causing the locking member to be at the locking member engagement position, and wherein when the lock bar is manually operated to be moved to the lock bar disengagement position, the cross member is at a bottom extremity of the oblique through hole, causing the locking member to be at the locking member disengagement position.

5. The self-latching device of claim 4, wherein the locking member further comprises a horizontal bottom surface opposite to the second engagement surface, the locking member is received within the lock hole and laterally slidable relative to the magnet bar such that it is received within the pair of wall holes as the cross member is slidably received within the oblique through hole, the top surfaces and bottom surfaces of the wall holes abut the second engagement and bottom surfaces of the locking member as the locking member is received within the pair of wall holes.

6. The self-latching device of claim 5, wherein the locking member includes first and second opposing sides extending between the second engagement surface and the bottom surface, wherein the first side is closer to the first engagement surface and is forwardly oblique relative to the second side.

7. The self-latching device of claim 4, wherein the top portion of the magnet bar further comprises a release knob for enabling a user to manually lift the magnet bar upwards towards the magnet bar disengagement position, wherein the hollow portion of the magnet bar extends through the release knob.

8. The self-latching device of claim 4, wherein the lock bar further comprises:

(a) a top press section about which the lock bar is manually depressed into the hollow portion of the magnet bar; and (b) a lock bar elongate section within which the lock hole is disposed.

9. The self-latching device of claim 4, wherein the cross member is removable.

10. The self-latching device of claim 1, wherein the latch bar comprises a head portion disposed at an extremity thereof, wherein the head portion abuts the magnet through the latch hole.

11. The self-latching device of claim 1, wherein the magnet assembly housing comprises an open top removably fitted with a top cap having a central hole through which the magnet bar extends.

12. The self-latching device of claim 11, wherein a tubing descends from the circumference of the central hole, the tubing comprising the first engagement surface.

13. A self-latching magnetic gate latch device for latching a hinged gate to a barrier member, the self-latching device comprising:

(a) a latch bar assembly comprising:

(i) a latch assembly housing fitted to one of the hinged gate and the barrier member; and (ii) a horizontally-disposed latch bar slidably disposed within the latch assembly housing such that the latch bar is axially movable from a default backward latch bar disengagement position to a forward latch bar engagement position, the latch bar biased towards the latch bar disengagement position, the latch bar attractable by a magnet;

(b) a magnet bar assembly comprising:

(i) an elongate magnet assembly housing vertically fitted to the other of the hinged gate and the barrier member, the magnet assembly housing comprising an open top removably fitted with a top cap comprising a central hole, wherein a tubing descends from a circular edge of the central hole, the tubing comprising a horizontal first engagement surface, the magnet assembly housing further comprising a latch hole axially aligned with the latch bar;

(ii) an elongate vertical magnet bar comprising a release knob and the magnet secured to a top and bottom thereof respectively, the magnet bar slidably disposed within the magnet assembly housing such that the magnet bar is manually vertically movable from a default downward magnet bar engagement position to an upward magnet bar disengagement position, the magnet bar is biased towards the magnet bar engagement position, where the magnet, via the latch hole, is aligned with the latch bar, the magnet bar is upwardly movable by manually lifting the release knob, which extends beyond the open top of the magnet assembly housing, the release knob is included in a portion of the length of the magnet bar that is longitudinally hollowed out such that a circumferential wall of the hollowed out portion of the magnet bar comprising a pair of opposing identical wall holes, each of which comprises a horizontal wall hole top surface, which, in the magnet bar engagement position, aligns with the first engagement surface; and (iii) an elongate vertical lock bar comprising a top press section and a lock bar elongate section, the lock bar elongate section comprising a through lateral lock hole, a height of which extends along an axis of the magnet bar and is greater than a height of each of the wall holes, the lock hole disposed between a pair of opposing flat lock hole walls integral with the lock bar, the pair of lock hole walls centrally removably fitted with an elongate cylindrical cross member such that the cross member is perpendicular to both lock hole walls, the lock bar is received within the hollowed out portion of the magnet bar such that the lock hole is disposed between the pair of wall holes, wherein by a manual depression of the top section, the lock bar is movable from a default upward lock bar engagement position to a downward lock bar disengagement position, and wherein the lock bar is biased towards the lock bar engagement position; and (c) a locking member comprising a horizontal top second engagement surface, a horizontal bottom surface, and an elongate backwardly oblique hole, the locking member is received within the lock hole and is laterally slidable relative to the magnet bar such that the locking member is received within the pair of wall holes as the cross member is slidably received within the oblique hole, the top surfaces and bottom surfaces of the wall holes abut the top second engagement and bottom surfaces of the locking member as the locking member is received within the pair of wall holes, wherein the locking member is horizontally movable from a forward locking member engagement position to a backward locking member disengagement position by the manual depression of the lock bar, when the magnet bar is in the magnet bar engagement position, the locking member is movable from the forward locking member engagement position, in which the top second engagement surface engages the first engagement surface thereby preventing the magnet bar from any upward movement to the backward locking member disengagement position, in which the second engagement surface of the locking member disengages the first engagement surface thereby allowing the magnet bar to be lifted upwards, wherein the locking member is biased towards the locking member engagement position as the lock bar is biased towards the lock bar engagement position, and wherein the locking member includes first and second opposing sides extending between the second engagement surface and the bottom surface, wherein the first side is closer to the first engagement surface and is forwardly oblique relative to the second side; wherein when the magnet bar is in the magnet bar engagement position and the hinged gate and the barrier member are brought into opposition to one another, the latch bar is longitudinally aligned with the magnet such that an attraction force of the magnet moves the latch bar to the latch bar engagement position, in which the latch bar abuts the magnet through the magnet assembly housing thereby latching the hinged gate to the barrier member, and when the magnet bar is lifted upwards to the magnet bar disengagement position, the distance between the magnet and the latch bar is increased, causing the attraction force between the magnet and the latch bar to weaken, resulting in the latch bar retracting into the latch bar disengagement position thereby unlatching the hinged gate from the barrier member.

* * * * *